United States Patent [19]

Yoder, Jr.

[11] 4,168,596

[45] Sep. 25, 1979

[54] STANDING SEAM METAL ROOF STRUCTURE AND METHOD OF ASSEMBLY

[75] Inventor: George M. Yoder, Jr., Columbus, Miss.

[73] Assignee: The Ceco Corporation, Chicago, Ill.

[21] Appl. No.: 860,336

[22] Filed: Dec. 14, 1977

Related U.S. Application Data

[63] Continuation-in-part of Ser. No. 794,541, May 6, 1977, abandoned.

[51] Int. Cl.[2] ..... E04C 1/32

[52] U.S. Cl. ..... 52/462; 52/465; 52/588; 52/748; 52/520

[58] Field of Search ..... 52/460, 465, 469, 470, 52/472, 461, 588, 462, 463, 545, 478, 748, 524, 525, 520

[56] References Cited

U.S. PATENT DOCUMENTS

| | | | |
|---|---|---|---|
| 2,381,030 | 8/1945 | Blackburn | 52/472 |
| 3,253,376 | 5/1966 | Straus | 52/520 X |
| 3,312,028 | 4/1967 | Schroyer | 52/520 X |
| 3,320,711 | 5/1967 | Johnson | 52/520 |
| 3,511,011 | 5/1970 | Straus | 52/520 X |
| 3,606,720 | 9/1971 | Cookson | 52/545 X |
| 3,858,373 | 1/1975 | Day et al. | 52/520 X |
| 3,898,783 | 8/1975 | Matlock et al. | 52/520 X |
| 3,956,864 | 5/1976 | Fung | 52/588 X |
| 4,009,548 | 3/1977 | Hicks | 52/469 |
| 4,089,145 | 5/1978 | DeVries, Jr. et al. | 52/469 X |

*Primary Examiner*—Carl D. Friedman

*Attorney, Agent, or Firm*—McDougall, Hersh & Scott

[57] ABSTRACT

A plurality of identical metal roof panels are secured to the roof purlins by spaced metal clips. Each roof panel, which may be installed without regard to end-to-end orientation in its own plane, includes deformable tabs extending outwardly of its side edges. Adjacent roof panels are interlocked with each other by interengagement of the tabs in response to positioning of the panels in place. The clips which secure the roof panels to the purlins are also provided with deformable tabs arranged to interengage with the tabs of the roof panels thereby to hold the roof panels in place even prior to bending of the tabs. The tabs are bent downwardly and a sealing strip is fitted over the bent tabs to weatherproof the seam. The roof is constructed using these panels by proceeding from one end of the building to the other in a single pass.

15 Claims, 14 Drawing Figures

FIG.8
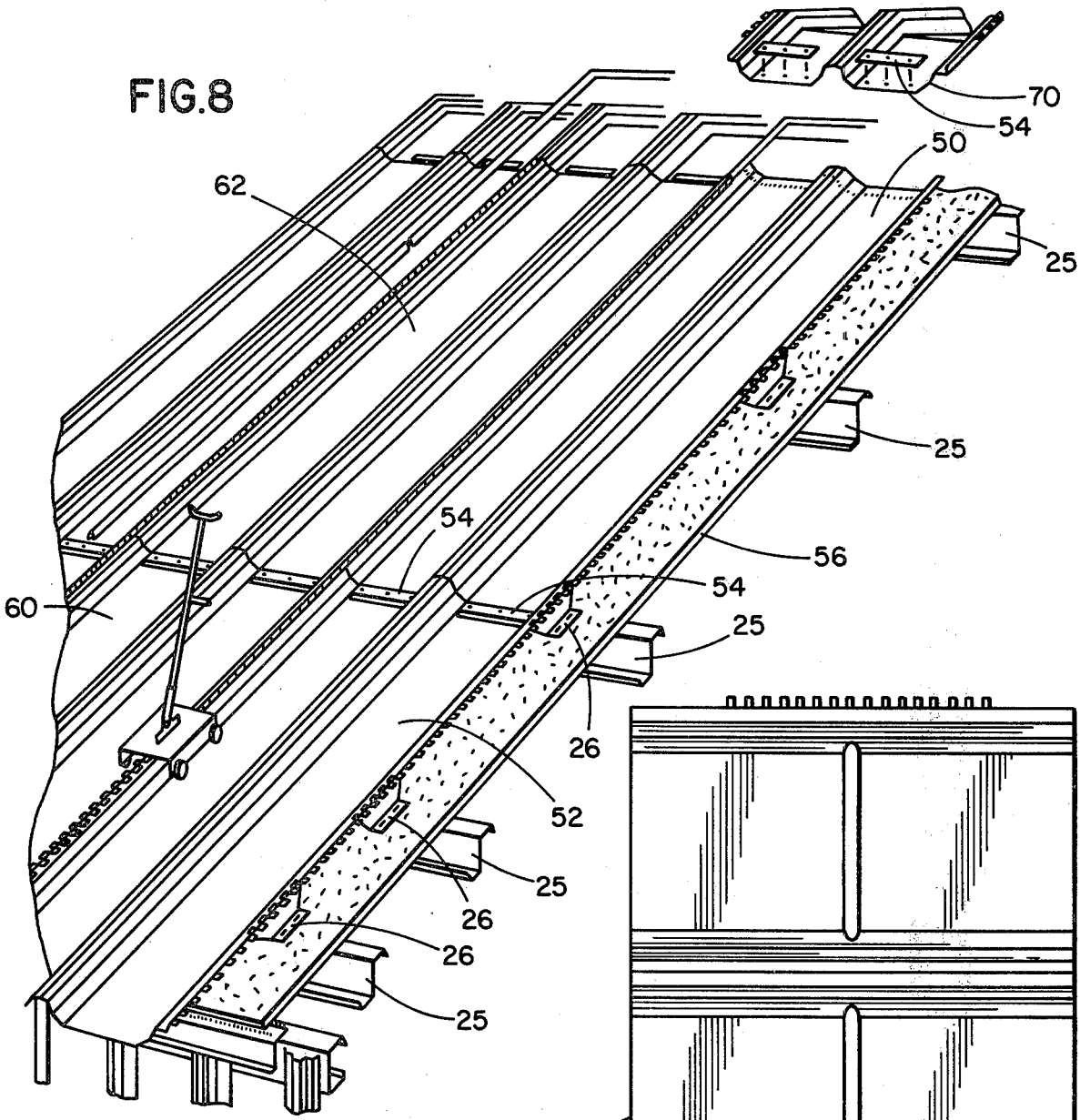
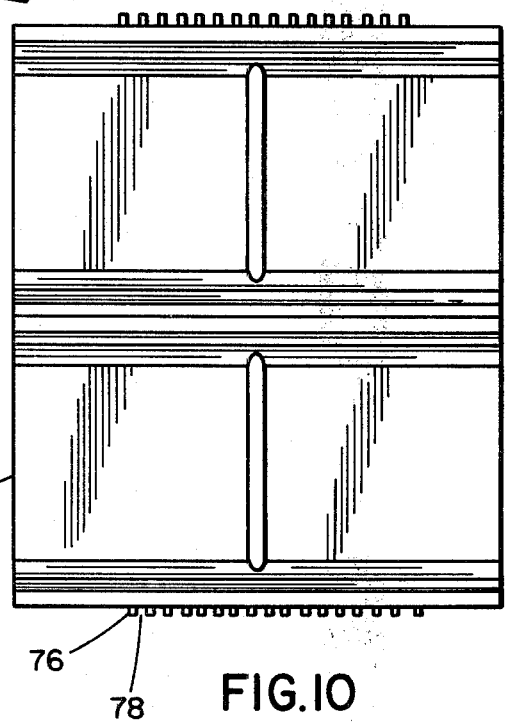
FIG.10
FIG.9
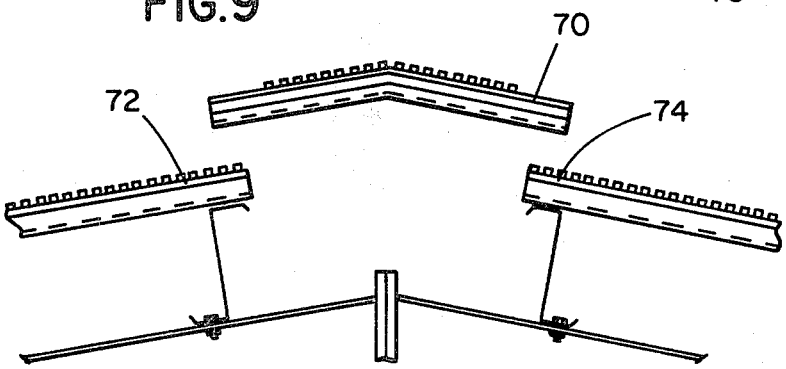

STANDING SEAM METAL ROOF STRUCTURE AND METHOD OF ASSEMBLY

CROSS-REFERENCE TO RELATED APPLICATION

This application is a continuation-in-part of Ser. No. 794,541, filed May 6, 1977, abandoned.

BACKGROUND OF THE INVENTION

The present invention relates to roof constructions for metal buildings. More particularly, the present invention relates to new and improved standing seam roof panels, clips for securing the roof panels to the purlins, and the method for assembling such panels and clips to form a roof. The term "standing seam" has reference to the panel joint construction which is elevated above the lowest point of the sheet—hence, water is less likely to reach the height of the joint.

PRIOR ART STATEMENT

Many different forms of standing seam metal roof panels are known to those skilled in the art. Most of these roof panels suffer from three principal disadvantages: (1) means for interlocking the side edge of one panel with the side edge of an adjacent panel is complicated contributing both to high cost of construction of the panel as well as to high cost of erecting a building with such panels; (2) such panels require proper orientation in a particular end-to-end and side-to-side relationship to properly fit which increases the time and cost of assembly of a building; and (3) the panels must be assembled in a certain sequence that the roof may not be completed in a single pass from one end of the building to the other.

More particularly, most modern day standing seam metal roof panels are characterized by a rather complicated cross-sectional configuration at the side flanges thereof, this cross-sectional configuration being provided for the purpose of interlocking one of these panels with an adjacent panel. The technique of interlocking such roof panels is rather complicated in that it involves rotating or swinging the panels in a specific manner to achieve interlocking. The closest prior art references of which applicant is aware are: Johnson U.S. Pat. No. 3,320,711; Straus, No. 3,511,011; Matlock et al, No. 3,898,783 and the following patents cited in parent application Ser. No. 794,541, filed May 6, 1977: Day et al, U.S. Pat. No. 3,889,437; Fung U.S. Pat. No. 3,956,864; and Hayman, U.S. Pat. No. 1,693,274.

The prior art also contains many forms of clips or connectors for securing metal roof panels to the underlying construction, i.e., the roof purlins. Representative prior art showing such clips include: Straus U.S. Pat. No. 3,253,376; Schroyer, U.S. Pat. No. 3,312,028; Day et al, U.S. Pat. No. 3,858,373; and Day et al, U.S. Pat. No. 3,889,437. These clips are somewhat complicated in construction and require the roof panels to be oriented in a specific manner to achieve interlocking.

SUMMARY AND OBJECTS OF THE INVENTION

The present invention is principally characterized by a standing seam metal roof panel having unique interlocking means which permits a panel to be interlocked with an adjacent panel without regard to the end-to-end or side-to-side relationship of such panels. That is, the panels may be randomly oriented as compared to the prior art which required that a first side always be placed adjacent the second side to engage properly. For the purposes of this application the panels of the present invention will be referred to as being "orientation insensitive" when it is desired to indicate their ability to interengage regardless of which ends are placed adjacent each other. The present invention is also characterized by a clip which readily interlocks with the roof panels and serves to hold the latter in place, at least to a limited extent, even prior to deforming of the interlocking means on the roof panels.

The invention also contemplates a method of assembling a roof structure employing panels according to the invention. The method permits assembly of complete sections of a building roof so that a weather tight enclosure is obtained over the portion of the roof completed. This is a distinct advantage over the prior art wherein the roof sections cannot be fully secured until the roof panels have been applied over the entire building. The present invention also permits the roof to be constructed by proceeding in a single pass from one side of the building to the other.

The invention also contemplates a method of assembling a roof structure employing panels according to the invention. The method permits easy assembly of complete sections of a building roof in various geometric patterns so that a weather tight enclosure is obtained over partial or full width segments of the building. This full width portion can be located at any point throughout the length of the building. This flexibility allows the panel to be placed over a given central or end located building section for the full width of the building.

A primary object of the present invention is the provision of a new and improved standing seam metal roof panel which has interlocking means along its side edges and is orientation insensitive permitting the panel to be interengaged with an adjacent panel without regard to the end-to-end or side-to-side relationship of such panels.

Another object of the present invention is the provision of an orientation insensitive standing seam metal roof panel of the type described which may be quickly and easily interlocked with an adjacent roof panel singly in response to positioning the panel in place and without the need for swinging or rotating the roof panels through any special or particular motion.

Still another object of the present invention is the provision of a clip for securing the roof panels to the roof purlins, which clip has the ability to hold the roof panels in place, at least to a limited extent, simply as a result of interengaging certain tabs on the clip with tabs on the roof panels and without the necessity of bending such tabs to obtain such limited holding of the roof panels to the purlins.

A further object of the present invention is the provision of roof panels and connecting clips of the type described, wherein the interlocking formations thereof may be readily deformed and enclosed with a sealing strip to obtain a weatherproof seal.

Another object of the invention is the provision of a method for installing a standing seam roof employing panels of the type disclosed whereby weather tight sections of the roof may be completed prior to completion of the entire roof structure and whereby the roof may be constructed in a single pass proceeding from one end of the building to the other.

These and other objects and advantages of the present invention will become apparent from the following specification disclosing a preferred embodiment shown in the accompanying drawings.

BRIEF DESCRIPTION OF THE DRAWINGS

FIG. 8 is an isometric view of a roof formed according to the method of the present invention.

FIG. 9 is an end elevation illustrating the use of a specialized ridge panel in conjunction with regular panels according to the invention.

FIG. 10 is a plan view of the ridge panel illustrated in FIG. 9.

DESCRIPTION OF THE PREFERRED EMBODIMENT

Figures 1, 2, 4, 6:
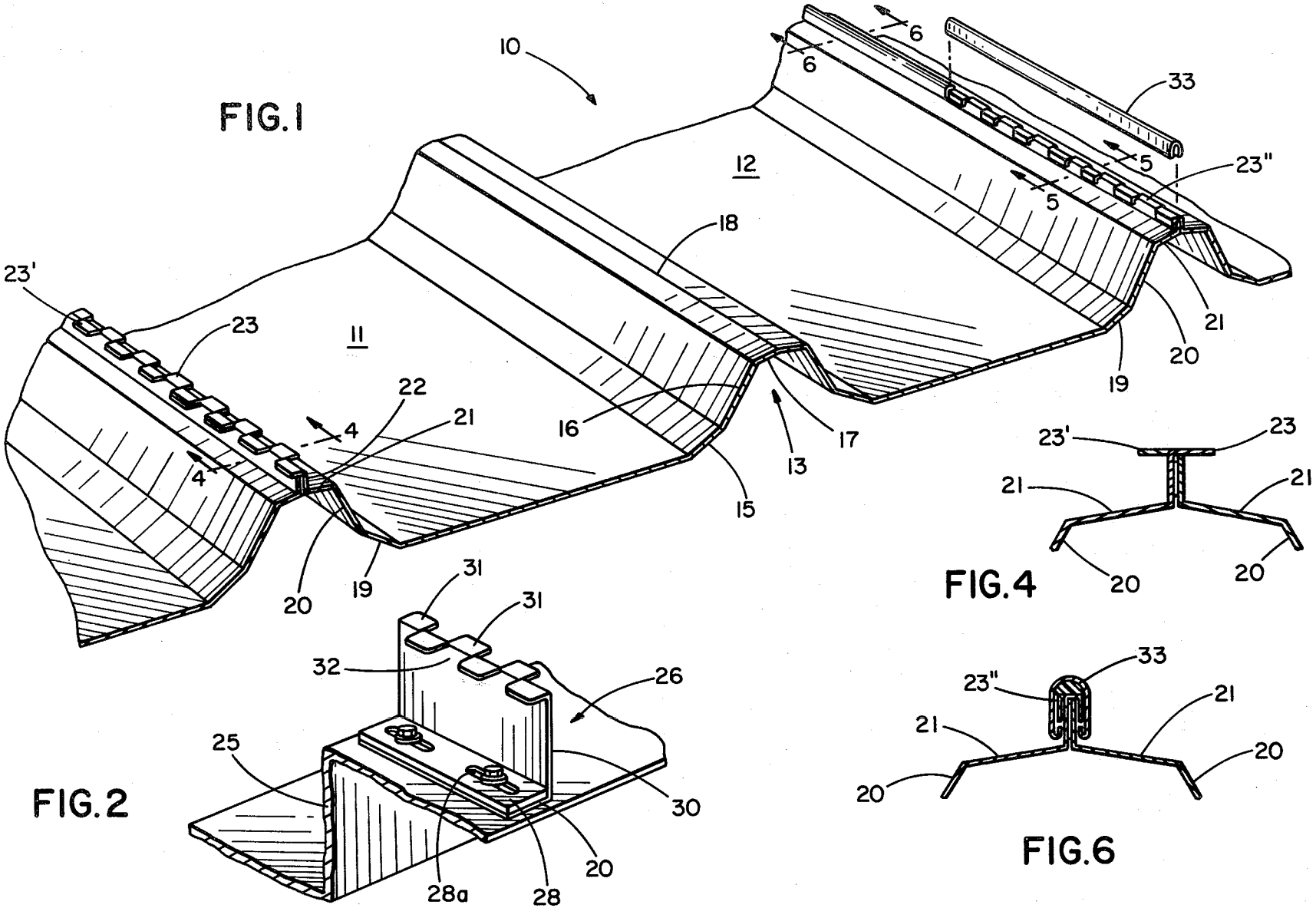
FIG. 1 is a fragmentary, isometric view of the roof structure according to the present invention.
FIG. 2 is an enlarged fragmentary, isometric view showing the clip of the present invention secured to a roof purlin.
FIG. 4 is an enlarged section taken along the line 4—4 of FIG. 1.
FIG. 6 is an enlarged section taken along the line 6—6 of FIG. 1.

Referring particularly to FIG. 1, a standing seam metal roof panel, generally designated 10, includes coplanar web portions 11 and 12 separated by a rib 13. This rib is characterized by inclined walls 15, 16 and 17 on each side of the center line 18. Of course, the exact configuration of the rib is not critical and may be varied for aesthetic or structural reasons. The ends of the panel are defined by straight edges perpendicular to the longitudinal center axis. The planar webs 11 and 12 terminate at an inclined wall 19, the latter in turn joining with another inclined wall 20. The wall 20 joins with a further wall 21 which is also inclined but at a smaller angle to the plane containing the webs 11 and 13 than wall 20. It will be understood that when a roof panel 10 is interlocked with an adjacent panel, the walls 19, 20 and 21 of one panel and the same walls of the adjacent panel define a recess preferably having a cross-sectional shape substantially the same as the cross-sectional shape of the rib 13.

Figure 3:
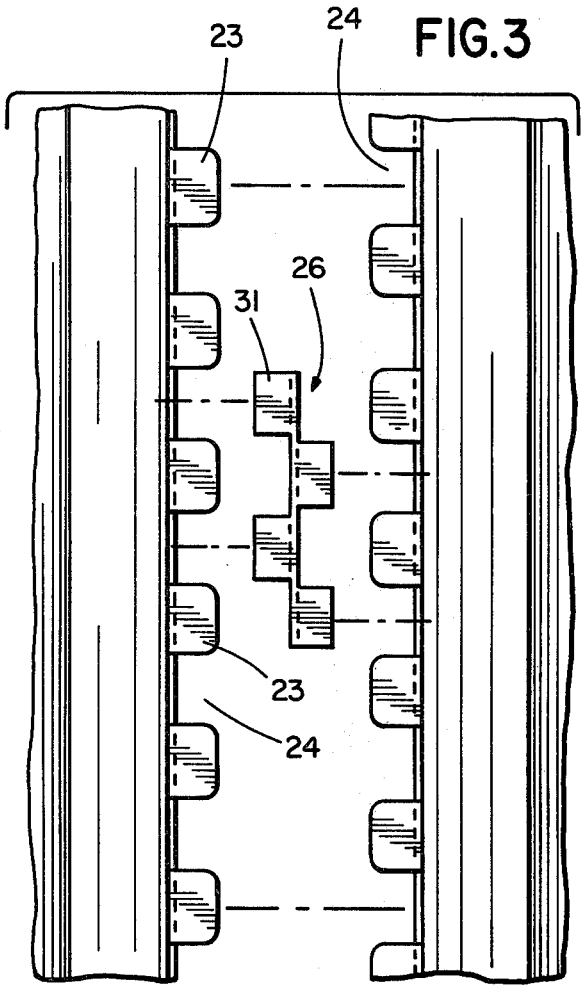
FIG. 3 is an enlarged top plan view showing the clip and fragmentary portions of adjacent roof panels.
Figure 7A:
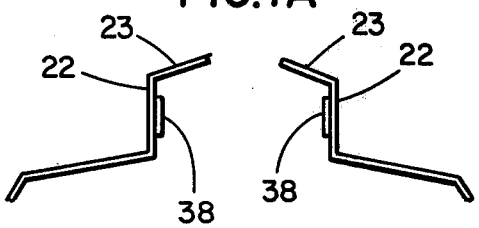
FIGS. 7A through G are enlarged sectional views similar to FIG. 4 illustrating the steps of assembly of two adjacent roof panels.
Figure 5:
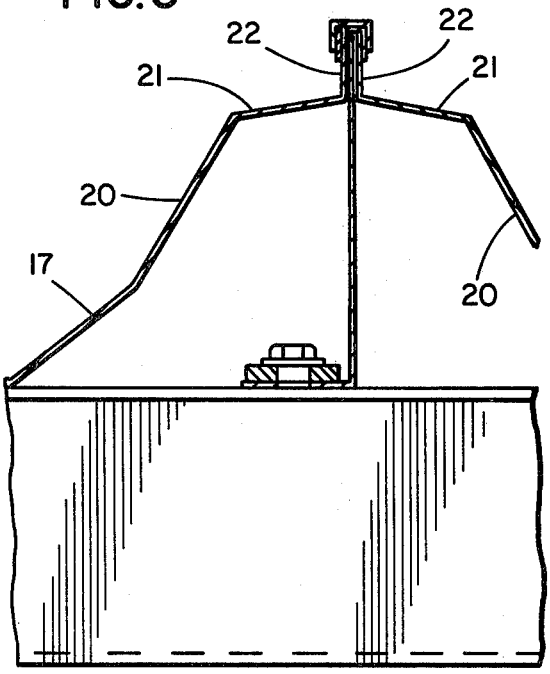
FIG. 5 is an enlarged section taken along the line 5—5 of FIG. 1.

The wall 21 terminates in an upstanding flange 22 (FIG. 5). A series of interlocking tabs 23 extend outwardly of the roof panel from the distal edge of the flange 22 (FIG. 3). These tabs are deformable and, as indicated in FIG. 7A, are coplanar in a plane disposed at a small angle (about 20°) to the plane containing the webs 11 and 12. The tabs 23 define recesses 24 which are preferably only slightly wider than the width of the tabs to provide for manufacturing tolerances and to insure ease of assembly. Alternatively, the recesses may be up to ten (10) times the width of the tabs 23 in which case the tabs would be spaced a substantial distance from each other. The tabs can be spaced up to approximately ten times their width without a significant loss in structural integrity in the assembled roof structure.

Figure 2A:
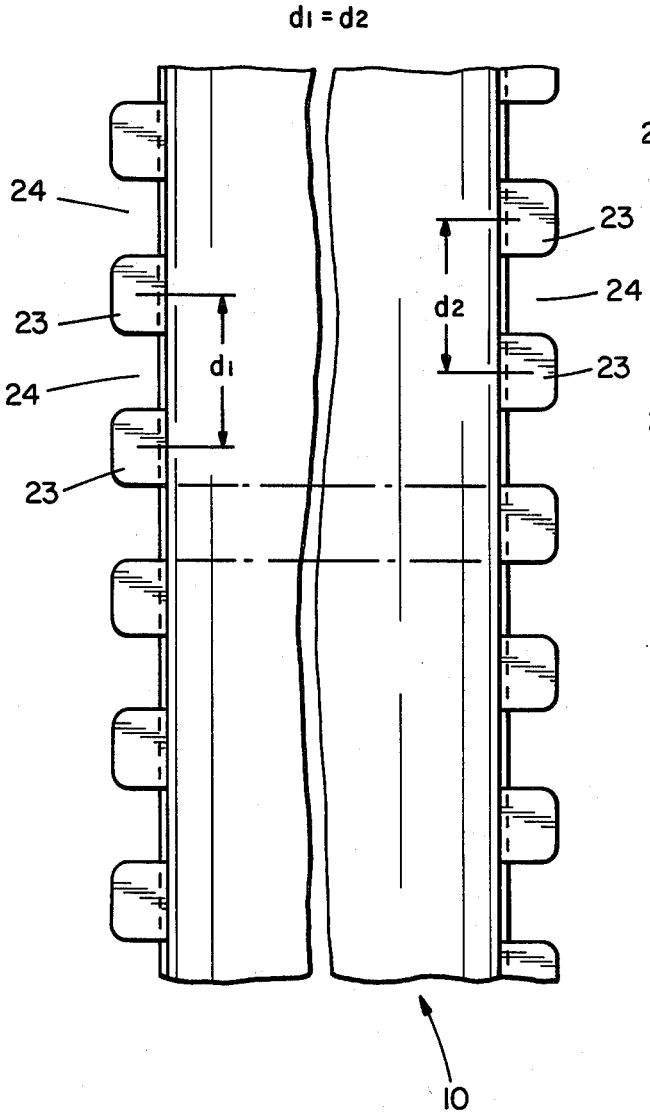
FIGS. 2A and 2B are plan views of a panel illustrating the relationship between the tabs and slots on each side of the panel.
Figure 2B:
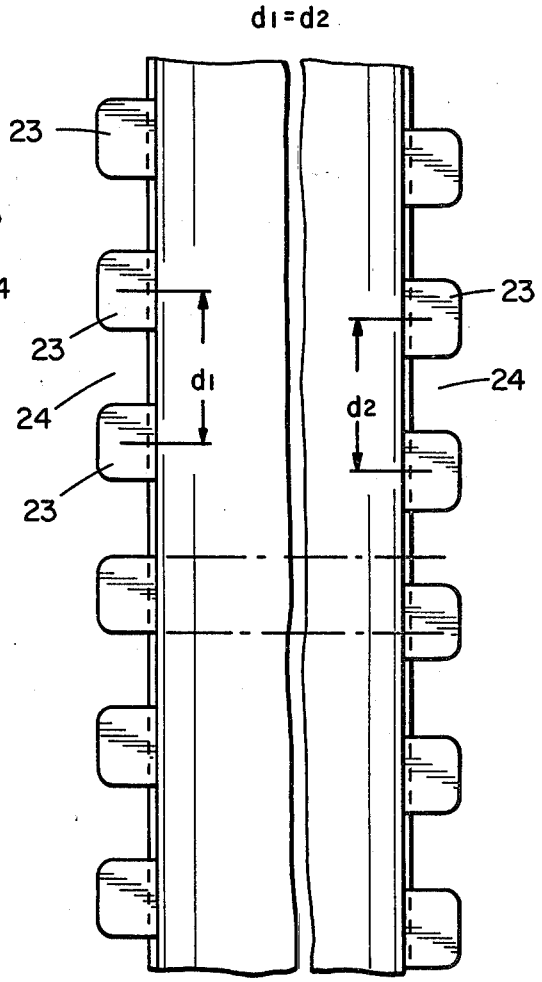

Referring now to FIGS. 2A and 2B, a principal advantage of the invention is illustrated. As indicated in the background portion, one of the unique capabilities of the present invention is the ability of the panels to be assembled without regard to their end-to-end or side-to-side relationship. In order to achieve this orientation insensitive structure, it is necessary to provide the panels with a specified relationship between the tabs located on opposite sides of the same panel. FIG. 2A represents a preferred embodiment in which the spacing of the tabs and slots is such that when adjacent panels are joined their ends are in alignment, i.e., not staggered. In order to achieve this result, the tabs on one side of the panel are offset directly opposite a recess on the other side of the panel. FIG. 2B illustrates a second alternative arrangement for the tabs and slots on a panel wherein the tabs on one side of the panel are not directly opposite a recess on the opposite side. Rather, there is not definite relationship between the location of the tabs on one side with respect to the tabs or slots on the opposite side.

The critical element with respect to the placement of the tabs on the panel is the spacing between centers of the tabs and in both embodiments the same relationship now to be described holds true. The distance d1 between centers of tabs 23 must be the same as the distance d2, the distance between centers of the tabs 23' on the other side of the panel. This spacing is critical in both embodiments in order to insure that adjacent panels may be interdigitated without regard to the end-to-end or side-to-side relationship of the adjacent panels. This produces the desired result heretofore unavailable in an orientation insensitive panel.

The FIG. 2A embodiment in which the tabs 23 on one side are directly across from recesses on the other side produces a straight end along adjacent panels. The FIG. 2B embodiment, exemplary of an entire class of panels wherein the tabs on one side need not have any specific location relative to the tabs on the other side, insures that the panels are orientation insensitive and will interengage, as desired. However, since the tabs on one side are not necessarily offset from a tab on the other side, it may be necessary to position adjacent panels, offset one from the other, by a small amount. In this case, the panel ends may require either pre or post installation trimming to obtain a common end line between adjacent panels.

It will be understood that the roof panels 10 are supported by the usual arrangement of beam members, viz., a plurality of purlins. In this regard, reference should be had to FIGS. 2 and 5 showing a fragmentary portion of a purlin 25 of Z-shape cross-section. It will also be understood that these purlins are supported in the usual fashion from the underlying structural members, such as a plurality of bar joists, for example.

The present invention also includes a clip, generally designated 26. This clip includes a flange foot portion 27 which is preferably reinforced by a plate 28 secured thereto. The plate 28 is provided with a pair of slots 28*a* (corresponding slots are formed in the foot 27). The clip is secured to the purlin by fasteners. Such fasteners serve to connect the clip 26 securely to the purlin and are installed through slots 28*a*.

The clip 26 is further defined by an upstanding web 30. A plurality of tabs 31 extend from the distal edge of the flange in oppositely disposed, alternate relationship. The tabs 31 define recesses 32 therebetween, the latter having a width slightly greater than the width of the tabs 31. These tabs are substantially the same in size as the tabs 23, at least in the longitudinal direction, so that the tabs 31 may be readily interengaged with the tabs 23 as will be explained below. It wll be understood that the tabs 31 are readily deformable, as is the case with the tabs 23.

A weatherproof seal is brought about at the adjoining portions of the roof panels by means of a sealing cap 33 and foam tape 38. This sealing cap, which may be made of metal, is an inverted U-shaped cross-section. Preferably, a mastic formation 34 is provided within the cap 33. The tap 38 is provided on the sides of flanges 22 which contact each other during assembly to insure formation of a weatherproof seam (FIGS. 7A and B). Alternately, the cap may be elongated and extend to a point of contact with the wall 21. Tape 38 is provided on the bottom of the cap, as illustrated in FIG. 7G, to seal the seam. In that case, mastic is not required inside the sealing cap.

Referring now to FIGS. 3, 5 and 7, the joining of the panels to each other and to the clips will be explained. By looking to FIG. 3, it is clear that when a pair of panels are placed in proper alignment adjacent the clip 26, the tabs 23 from both panels are spaced to engage the corresponding recesses 24 on the opposite panel and to simultaneously sandwich therebetween the tabs 31 of the clip 26. After the first panel is installed the clips 26 are secured at the appropriate locations on the purlins 25. The panels are then rested in place with the web portions 11 and 12 resting on the purlins or on insulation provided over the purlins. Once aligned, as illustrated in FIG. 3, the panels are positioned together to cause interengagement of the tabs 23 and the tabs 31 of the clip. It will be apparent that this interengagement results simply from sliding the panels into their proper positions. The clips serve to immediately hold the roof panels in place even prior to bending the tabs. Also, by reason of interengagement of the tabs 23, adjacent panels are connected to each other to a substantial degree prior to bending of such tabs.

After the roof panels are interengaged with each other and with the clips as just described, the tabs 23 and the tabs 31 are preferably deformed or bent over by a suitable tool. This tool need not be powered but may be manually operated. This is possible because the tabs are individually bent one at a time and thus do not offer significant resistance to bending, as would be the case with a continuous tab or flange, for example. After the tabs have been bent downwardly, the sealing cap 33 is snapped in place thereby to provide a weatherproof seal.

Figure 7B:
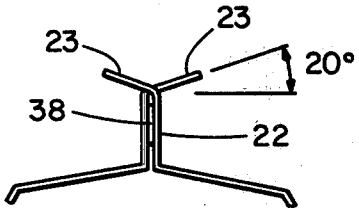
Figure 7C:
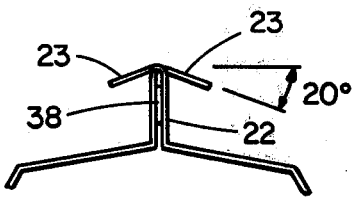
Figure 7D:
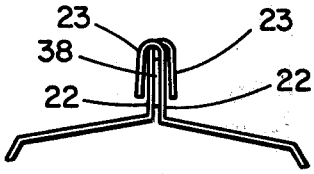
Figure 7G:
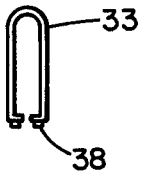
Figure 7E:
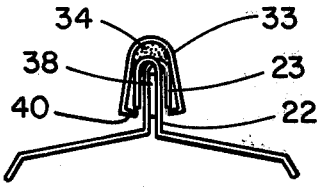
Figure 7F:
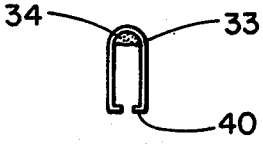

FIGS. 7A through F illustrate the method of assembling a roof structure according to the invention. In FIG. 7A two panels are in alignment preparatory to engaging the tabs and slots. In FIG. 7B the panels have been butted together so that the tabs and slots are in engagement and the foam tape 38 is sandwiched between the flanges 22 to form a portion of the weather seal. In FIG. 7C the tabs 23 have been partly bent by the tool illustrated in FIG. 12 while in FIG. 7D the final bending has been accomplished whereby the tabs are bent substantially 180° with respect to the flange from which they depend. In FIG. 7E the sealing cap 33 has been applied over the tabs and slots and is secured in place by the action of the mastic 34 and the bottom legs 40 of the cap which engage the ends of the tabs. In order to insure a snug fit, the sealing cap is narrower than the dimensions of the tabs over which it will fit so that, as illustrated in FIG. 7E, it must be elastically deformed by manual pressure when it is placed over the tabs and thus securely engages the tabs as illustrated.

Referring to FIGS. 8 through 10, the method of constructing a roof structure according to the invention is illustrated. In FIG. 8 a portion of a sloped roof is illustrated in which the panels according to the invention are being secured to a plurality of purlins 25. Depending upon the size of the roof structure, it may be necessary to utilize more than one panel to reach from the ridge or top of the roof to the eave of the roof. In that case the end of one panel is overlapped with another panel so that the tabs of the upper panel are directly over the tabs of the lower panel. The two panels are then secured together by conventional means as, for example, a bracket bolted to both panels. This is illustrated in FIG. 8 wherein a panel 50 is connected to a panel 52 by means of brackets 54 on either side of the rib 13.

In constructing a roof structure of this type it is desirable first to install an insulating layer 56 (FIG. 8) over the purlins and then attach the panels 52 and 60 to the purlins. Adjacent panels 60 and 62 are interengaged with the side edges of panels 50 and 52 after a row of clips 26 have been installed whereby the four panels are thereby secured to the clips during the interengagement process. In a similar manner the rest of the roof structure can be assembled with the exception of the ridge which requires a special panel described in connection with FIGS. 9 and 10. The bending of the tabs 23 may be accomplished immediately after interengagement of adjacent panels or, because of the fact that the panels are held in place even before tab bending by the clips 26, it is possible to delay bending the tabs until a sizable segment of the roof structure has been completed. In either case, when it is desired to secure the roof panels permanently to each other and to the clips, the tool of FIG. 12 is employed for bending the tabs downwardly into the position illustrated in FIG. 7D.

Referring to FIGS. 9 and 10, the ridge panel 70 is illustrated. This panel is utilized to cover the ridge of a sloped roof and to engage the upper end portions of the regular panels on either side of the ridge. The ridge panel is identical in cross-section with the panel of FIG. 1, except that at its midpoint it is bent by an amount approximating the slope of the roof for which it is intended and that tabs are omitted on the ends where these panels join the regular panels to avoid interference between the ridge panel tabs and the regular panel tabs. This ridge panel overlaps the top portion of the panel 72 and 74 (FIG. 9) and is secured in place by the use of brackets 54 (FIG. 8) at the point of overlap and by the tab and slot interengagement with adjacent ridge panels. For this latter purpose the ridge panel 70 is provided with tabs 76 and slots 78 of substantially identical spacing as described for the panel of FIG. 1.

Figure 11:
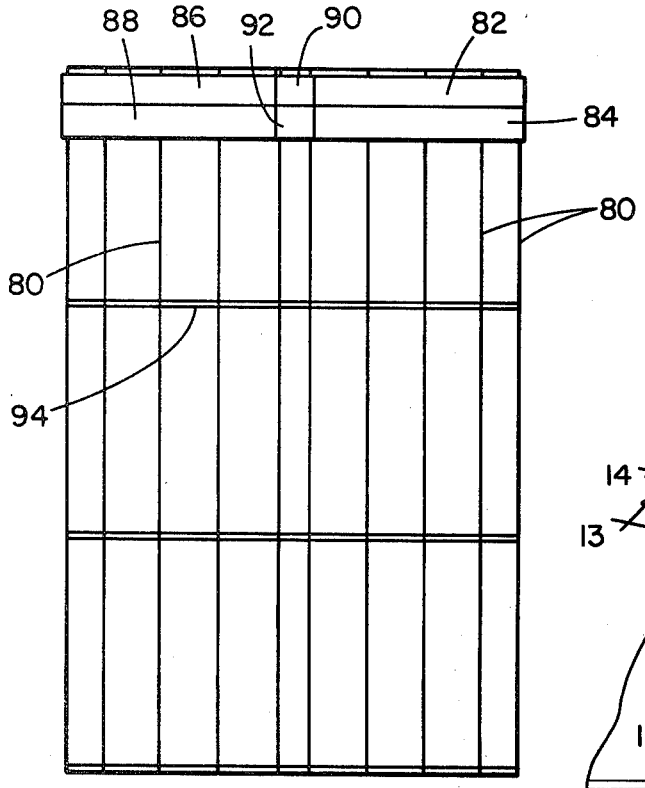
FIG. 11 is a top plan view, in diagrammatic form, of a building showing the installation method according to the invention.

A plan view of a roof to be constructed is shown in FIG. 11. The lines 80 represent the purlins to which the roof panels are secured; the rectangular areas 82, 84, 86, 88, 90 and 92 represent roof panels according to the invention. A significant advantage of the present invention over the prior art is the ability to complete the installation of a selected section of the roof prior to completion of the entire roof. Thus, a portion of a roof can be completely installed and the area thereunder will be weather tight. For example, panels 82 and 86 and ridge panel 90 can be installed together with panel 84, 88 and 92. This process could then be continued until one-third of the roof were completed as indicated by line 94. Similarly, if desired, the roof panel installation could begin at any one point on the roof and installed in any direction beginning from the first panel. Thus, the middle portion of a roof could be completed first and then work could continue towards the two ends of the building at the same time or at different times. Because of the construction of prior art panels and their manner of interengagement, it is usually necessary to work from opposite corners of the roof and thus no section of the roof can be completed until substantially all of the roof panels are installed.

Figure 12:
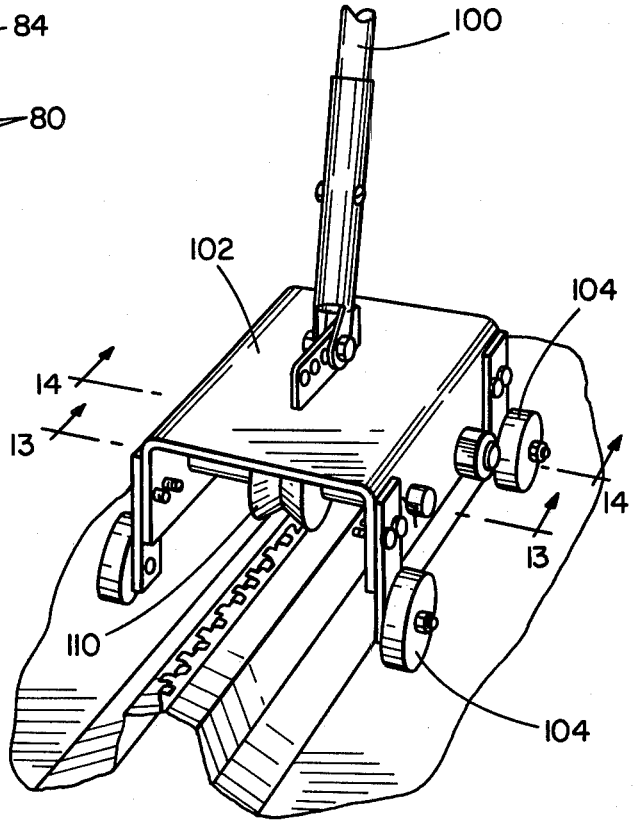
FIG. 12 is an isometric view of a portable device utilized for bending the tabs of the roof panels and clips.
Figure 13:
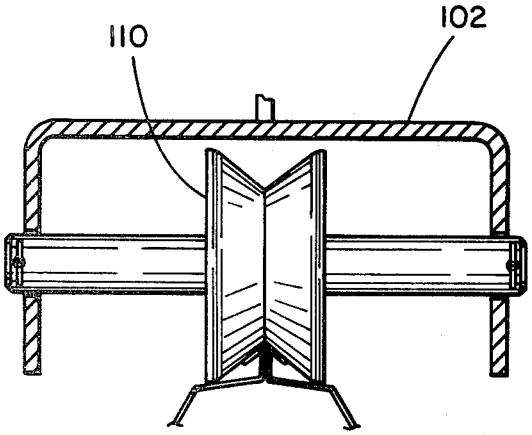
FIG. 13 is a sectional view along the lines 13—13 of FIG. 12.
Figure 14:
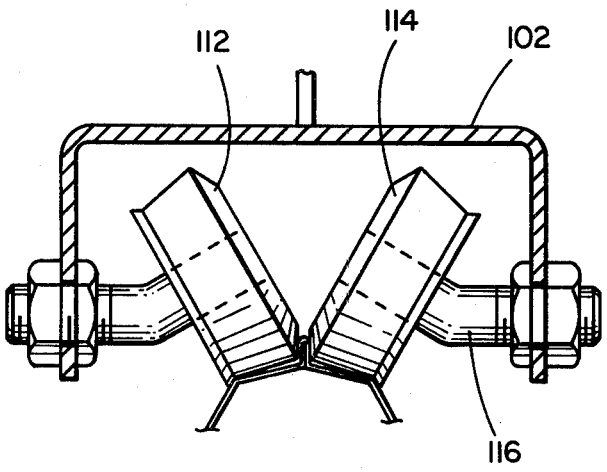
FIG. 14 is a sectional view along the lines 14—14 of FIG. 12.

FIGS. 12, 13 and 14 illustrate a tool suitable for bending the tabs of the roof panels. This seaming tool includes a handle 100 attached to a U-shaped frame 102 mounted on a set of wheels 104 for movement along the roof panels. The dimension of the frame 102 is such that it straddles the seam structure of the panels and can be rolled along the panel webs. As best seen in FIG. 13, a forming roll 110 is rotatably mounted to the underside of the frame 102 at a proper height to engage the panel tabs. This forming wall, which is V-shaped, affects the first bending step illustrated in FIG. 7C. Mounted rearwardly of the roll 110 is a pair of cooperating rolls 112 and 114 having contoured surfaces for effecting the second step of the tab bending illustrated in FIG. 7D. These rolls are mounted to the frame 102 on shafts 116 which include an elbow to position the rolls correctly. After the tabs have been bent by use of the FIG. 12 seaming tool, the weather cap 33 is pressed in place to complete the seam. Because the tabs are bent one at a time thereby offering little resistance, this single manually operated tool may be used rather than a powered tool required with many prior art systems.

Briefly summarizing the installation method, insulation is placed over the purlins. Thereafter, one end of the first panel is secured to the edge of a roof structure by suitable means. Clips are then mounted at the point where adjacent panels are to be joined to form a standing seam. The next panel is then positioned and interengaged so that the tabs and slots of the two panels are interdigitated with the tabs of the clip sandwiched therebetween. If additional panels are necessary to reach the top of the roof, these additional panels are overlapped and secured by use of brackets. At the top of a sloped roof a ridge panel having an appropriate bend therein is utilized. After a section of roof has been temporarily secured in this manner it may be completed by bending the tabs over and applying the weather cap thus obtaining a weather tight roof structure for any desired portion of the entire building.

Accordingly, it will be seen that the advantages of the present invention include the following:

A. The panels may be arranged in an end-to-end or side-to-side relationship and still may be readily engaged with each other. This orientation insensitive feature greatly simplifies construction of the panel and the roof.

B. The roof panels need not be notched for endlaps or for connecting with peak and eave sheets.

C. The roof panels may be assembled working from any point of the building and without the necessity of starting from opposite diagonal corners as is the case with many prior art panels.

D. The roof panels will nest perfectly thereby facilitating packaging and handling prior to erection.

E. The roof construction of the present invention does not require staggering of endlaps on alternate purlins.

F. The roof panels are self-aligning due to the interlocking of the tabs on the roof panels and the tabs on the clips.

G. If the interlocking tabs on the standing seam roof panels are bent out of shape prior to interlocking this condition will be readily apparent and may be easily corrected.

H. Since the clips serve to hold the standing seam roof panels to the purlins, at least to a limited extent, prior to deformation of the tabs on the panels and the tabs on the clips, the likelihood of damage due to wind factors during erection is greatly minimized.

I. Since the tabs may be individually deformed, as opposed to deforming or bending a continuous flange as in prior art panels, a manually operated seaming device, rather than a powered seaming device, may be used.

J. Because of the orientation insensitivity of the roof panels and because of the construction of the interlocking tabs, a damaged panel may be readily replaced individually without destroying adjacent panels.

K. The roof panels may be interlocked simply by sliding one panel along the purlins and toward the adjacent panel.

L. Because of the addition of a full size longitudinal rib along the centerline of the panel, the width of the panel can be increased from two feet (which is the current state of the art maximum standing seam panel width) to two and one-half feet without sacrificing the structural strength of the panel. This feature reduces both the manufacturing and installation cost of the panel, as compared to such costs for a two foot panel.

While I have shown and described embodiments of this invention in some detail, it will be understood that this description and illustrations are offered merely by way of example, and that the invention is to be limited in scope only by the appended claims.

I claim:

1. A standing seam metal roof panel comprising:

(a) a central web of rectangular shape, a substantial portion of which is planar;

(b) a continuous inclined wall extending from each side of said web along the entire length thereof and terminating in a flange perpendicularly disposed relative to said web;

(c) a series of deformable tabs extending from the distal edge of said flange along substantially the entire length thereof on both sides of said panel, said tabs projecting outwardly of the side edges of the roof panel, and defining spaced recesses therebetween each having a longitudinal extent at least as great as the longitudinal extent of each tab;

(d) the spacing between centers of the tabs on both sides of said panel being equal, whereby the panel is orientation insensitive and two such panels may be interlocked along their side edges by receipt of the tabs of each panel into the slots of the opposite panel followed by downward deformation of the tabs to a position parallel to the flanges, all without regard to the end-to-end or side-to-side relationship of the panels.

2. The roof panel according to claim 1 further defined by a rib formed in said web and extending along the longitudinal central axis thereof whereby the panel width can be increased without reducing overall panel strength.

3. The roof panel according to claim 2 wherein said rib defines a recess having a cross-sectional shape substantially the same as the cross-sectional shape of the recess formed by adjacent walls of a pair of said roof panels with the respective tabs and slots thereof interengaged with each other.

4. The roof panel according to claim 1 wherein said flanges are each provided with foam tape on the distal side thereof whereby said tape seals the standing seam against the entry of moisture.

5. A roof structure for a metal building comprising:

(a) a plurality of identical metal roof panels, each such panel including:
  (i) a central web of rectangular shape, a substantial portion of which is planar,
  (ii) a continuous inclined wall incuding a flange extending from each side of said web along the entire length thereof,
  (iii) a series of deformable tabs extending from the distal edge of said flange along substantially the entire length thereof on both sides of said panel, said tabs projecting outwardly of the side edges of the roof panel and defining spaced recesses therebetween each having a longitudinal extent at least as great as the longitudinal extent of each tab,
  (iv) the spacing between centers of the tabs on both sides of said panel being equal whereby each of said roof panels can be interlocked with an adjacent roof panel by receipt of the tabs of one panel into the slots of the adjacent panel and vice versa without regard to the end-to-end or side-to-side relationship of the panels;

(b) a supporting structure including a plurality of parallel spaced beam members extending perpendicularly to the longitudinal central axes of said roof panels with the webs of the roof panels resting on said beam members; and (c) a plurality of clips connecting said roof panels to said beam members, the clips being substantially equally spaced along each beam member, each clip including:
  (i) a flange portion fastened to the beam member,
  (ii) an upstanding web portion,
  (iii) a plurality of deformable tabs extending from the distal edge of said flange portion in alternate oppositely disposed relationship, said tabs interfitting with respective tabs of adjacent roof panels during interlocking of the latter, thereby serving to secure the roof panels to each other and to the beam members.

6. The roof construction according to claim 5 further defined by said tabs of the roof panels and the clip tabs associated therewith being bent downwardly; and a plurality of sealing caps, each cap extending longitudinally along the adjoining portions of each pair of roof panels, each cap being of inverted U-shape cross-section and receiving said bent tabs therein.

7. The roof construction according to claim 6 wherein a mastic is placed in each cap for forming a weatherproof seal between the adjoining portions of the roof panels.

8. The roof construction according to claim 6 wherein foam tape is provided on the bottom portion of the sealing cap for forming a weatherproof seal.

9. The roof construction according to claim 5 further defined by a rib formed in a web of each roof panel and extending along the longitudinal central axis thereof whereby the panel width can be increased without reducing overall panel strength.

10. The roof construction according to claim 9 wherein each of said ribs defines a recess having a cross-sectional shape substantially the same as the cross-sectional shape of the recess formed by adjacent walls of a pair of roof panels.

11. A method of erecting a standing seam roof structure on a rectangular metal building including spaced beam members arranged to form a roof having a ridge at the longitudinal centerline comprising the steps of:

(a) positioning first standing seam roof panels on said beam members at one end of said building on either side of the ridge of the building structure, said panels extending from points just short of the ridge of the building to the eaves thereof;

(b) securing the side edge portions of said panels, proximal to the building end, to the beam members;

(c) positioning a ridge panel over said ridge in overlapping relation with adjacent end portions of said roof panels;

(d) securing clips to said beam members adjacent the opposite side portions of said panels at selected points along the line where said standing seam is to be formed;

(e) positioning additional roof panels on said beam members adjacent said first panels on either side of said ridge as in step (a);

(f) securing the side edges of said additional roof panels to the side edges of the previously positioned panels and securing said panels to said clips, said securing being accomplished by the interengagement and downward deformation of tabs in slots located on the ends of said panels, the positioning of said tabs and slots on said panels rendering said panels quarter-symmetric whereby the panels are orientation insensitive and may be installed with either end facing an adjacent panel end;

(g) positioning a second ridge panel on said ridge as in step (c) adjacent said first ridge panel, interengaging the two and overlapping the second ridge panel with adjacent end portions of the additional roof panels;

(h) repeating steps (d) through (g) to complete a desired area of said roof structure;

whereby the roof structure is assembled in a single pass proceeding from said one end of the building to the other end, 12. The method of claim 11 further including the steps of:

(a) bending the tabs downwardly after interengagement to secure the panels permanently to each other and to the clip; and (b) applying an inverted U-shaped cap member over the tabs to weatherproof the standing seam.

13. The method of claim 11 wherein said clip is provided with tabs which are engaged by the tabs of adjacent roof panels during panel interengagement thereby to secure the panels to each other and to the beam members.

14. The method of claim 13 further including the steps of:

(a) bending the panel and clip tabs downwardly after interengagement to permanently secure the panels to each other and to the clip; and (b) applying an inverted U-shaped cap member over the tabs to weatherproof the standing seam.

15. The method of erecting a standing seam metal roof of a rectangular building including logitudinally spaced beam members comprising the steps of:

(a) positioning plural standing seam roof panels on said beams at any desired starting line to cover a section of said building.

(b) anchoring said roof panels in place along their side edges which are proximate to said starting line;

(c) anchoring the other side edges of said panels to said beams;

(d) positioning and securing plural additional standing seam roof panels on said beams by interengaging the side edges of the additional panels with the adjacent side edges of the first mentioned panels thereby to form a standing seam and to cover another section of said building, said securing being accomplished by the interengagement and downward deformation of tabs in slots located on the ends of said panels, the positioning of said tabs and slots on said panels rendering said panels quarter-symmetric whereby the panels are orientation insensitive and may be installed with either end facing an adjacent panel end;

(e) repeating steps (c) and (d) until any desired area of said building is covered; and (f) anchoring the last-positioned series of roof panels to said beam members.

* * * * *